US008663024B2

(12) United States Patent
Kardos

(10) Patent No.: US 8,663,024 B2
(45) Date of Patent: Mar. 4, 2014

(54) GOLF SETUP AND SWING TRAINING AID

(76) Inventor: David Ward Kardos, Sykesville, MD (US)

( * ) Notice: Subject to any disclaimer, the term of this patent is extended or adjusted under 35 U.S.C. 154(b) by 266 days.

(21) Appl. No.: 12/951,041

(22) Filed: Nov. 20, 2010

(65) Prior Publication Data

US 2011/0201439 A1 Aug. 18, 2011

Related U.S. Application Data

(60) Provisional application No. 61/338,354, filed on Feb. 18, 2010.

(51) Int. Cl.
*A63B 69/36* (2006.01)

(52) U.S. Cl.
USPC ..... 473/226; 473/212; 473/227

(58) Field of Classification Search
USPC ..... 473/201, 206, 207, 212, 213, 226, 227, 473/275, 276
See application file for complete search history.

(56) References Cited

U.S. PATENT DOCUMENTS

| | | | | | |
|---|---|---|---|---|---|
| 2,273,416 | A * | 2/1942 | Norwood | 473/206 |
| 4,944,516 | A * | 7/1990 | Bickler | 473/227 |
| 5,203,568 | A * | 4/1993 | Vasquez | 473/212 |
| 5,470,073 | A * | 11/1995 | Vasquez | 473/206 |
| 5,772,523 | A * | 6/1998 | Sheftic | 473/227 |
| 6,251,025 | B1 * | 6/2001 | Brock et al. | 473/227 |
| 6,491,591 | B1 * | 12/2002 | Schuster | 473/212 |
| 6,656,056 | B1 * | 12/2003 | Leonard | 473/227 |
| 8,128,507 | B1 * | 3/2012 | Chuck | 473/276 |
| 8,246,483 | B2 * | 8/2012 | Garno | 473/300 |
| 2007/0149301 | A1 * | 6/2007 | Cox | 473/207 |

* cited by examiner

*Primary Examiner* — Nini Legesse

(57) ABSTRACT

A golf swing training device for achieving a proper overall address position and for executing a proper golf swing, including setting the proper deviation of the wrists, setting the angular orientation between the shaft longitudinal axis and spine longitudinal axis as viewed from the side of the golfer, and for maintaining this deviation and angular orientation during the first part of the backswing. Held in fixed relation to the grip of the club is a member connected to a second flexible member that contacts the underside of the leading forearm when the golfer achieves a predetermined deviation of the wrist in the address position and during the first part of the backswing.

16 Claims, 13 Drawing Sheets

52 - 52

GOLF SETUP AND SWING TRAINING AID

CROSS-REFERENCE TO RELATED APPLICATION

This application claims the benefit of U.S. Provisional Application No. 61/338,354 filed on Feb. 18, 2010.

BACKGROUND OF THE INVENTION

The present invention pertains to the art of training devices and more specifically to a golf swing training aid, also sometimes referred to herein as a training device. This invention relates more specifically to a golf training aid for improving the capacity of a golfer to correctly execute the swinging of a golf club, and correctly and more consistently strike the golf ball.

Certain fundamental components of a properly executed golf swing have been identified and demonstrated over the years, and thousands of golfers spend a lot of time trying to improve their capacity to properly execute these components. Thus a need exists to train golfers on how to properly execute these components, and therefore properly swing the golf club and strike the golf ball well. One critical and fundamental component of a proper golf swing is positioning the parts of the body relative to the golf club and golf ball prior to initiating the swing, referred to as the address position. The locations and orientations of the player's body parts relative to the golf club and golf ball during the address position will greatly contribute to how well the swing can be executed, and will contribute to how well the golfer can strike the golf ball. Another critical component is the position of the golf club and body during the first part of the back swing, referred to as the take-away, and further contributes to how well a golfer will execute the golf swing.

One major motion of the golf swing is essentially the rotation of the shoulders, arms, hands and golf club, around the longitudinal axis of the spine of the golfer. Because the golf club is, in simplified terms, rotating around the spine during the swing, the orientation of the golf club relative to the spine in the address and take-away positions are of critical importance, and important factors in properly executing a full golf swing, as well as important factors in generating a higher club head speed. Simply stated, if a golfer is in the correct address and take-away positions, he will have a better chance of properly executing the golf swing and properly striking the golf ball with the golf club.

There are several major aspects of the proper address position. These include holding the club properly with the hands, the golf ball position relative to the body, the position of the feet relative to the rest of the body, and the orientations between different parts of the body, and between the body and the golf club. When a golfer is viewed from the side in the address position, one can see the body positions relative to the spine of the golfer. Unlike the majority of the address aspects, the body positions as viewed from the side of the golfer are aspects that the golfer cannot see himself. In order to verify the proper positions as viewed from the side, a trained professional would typically have to observe the golfer, and give him feedback. These trained professional teachers are what the professional golfers use during their golf training sessions and during rounds a golf.

Professional golfers all maintain the proper positions as viewed from the side of the golfer. Achieving proper and consistent address and take-away positions is not a natural feeling and not an easy task, and one that is generally achieved through many hours of education, training and practice. Equally important as a proper address position, is maintaining as many consistent elements within one's address position for every club that a player swings. The more consistency a player has between every swing and every club, the easier it will be to learn the proper golf swings, and the more consistent a player can become. Thus, a need exists for simple, effective, and easy to implement solutions to train golfers in achieving proper and consistent positions for every golf swing, without the necessity for a teacher.

The inventor is aware of various patents and published patent applications directed toward training golfers, and directed towards different aspects of the golf swing. These include the following:

- U.S. Pat. No. 6,939,243 by Mitchell and Robinson describes a golf training device that attaches to the top of the hand grip of a golf club with a plate that rests against the lower inner forward forearm of a golfer during putting and chipping to maintain a triangular formation of the arms with respect to the golf club.
- U.S. Pat. Application No. 2004/0198526 describes a golf swing trainer that teaches full swing positioning, and is essentially an extension of the golf club shaft that is a U-shaped member. The rigid member puts the leading forearm and wrist into particular positions throughout the swing.
- U.S. Pat. No. 3,918,721 describes a golf training device that attaches to the golf club, with a feeler that is intended to barely miss contact with the left forearm of a user at address, and contact a part of the body if the golfer's head moves improperly, if the golfer's wrists improperly break, or if the hands are not properly ahead of the club if they have swung improperly.
- U.S. Pat. No. 6,251,025 describes a golf training device that attaches to the shaft of the club and has a member that extends from the shaft and has a tip for contacting the lead arm of the player when the club is properly gripped with the leading hand at approximately right angles to the shaft of the club at the top of the back swing and the top of the follow through. It helps the golfer properly angle the wrists at the top of the back swing and the top of the swing follow-through.
- U.S. Pat. Application No. 2007/0275788 describes a golf training device that attaches to the golf club butt end, with a telescoping shaft part, an end cap that contacts the breast bone, and a hinge that pivots the extension relative to the telescoping shaft. The hinge allows the golfer to adjust the angle between the telescoping shaft and the golf club shaft to suit his or her posture at address.
- U.S. Pat. No. 5,390,928 describes a golfing aid that secures to the arm of the golfer with a strap, to maintain the upper wrist in a controlled position throughout the golf swing. It does not allow for the golfer to choke up on the club.
- U.S. Pat. No. 6,719,639 describes a training device to train a golfer to execute the so-called new millennium rotational body swing. It's purpose is to enable the golfer to simulate the feeling of "today's modern swing . . . ." The training device stays in contact with the radial bone of the golfers' leading arm from the beginning of the swing to the finish.

SUMMARY OF THE INVENTION

The present inventor has recognized that a drawback of the prior art training devices is that they are not intended to train the golfer to achieve the correct shaft, spine and forearm positions as viewed from the side of the golfer, nor to achieve a complete address position. Most rely on the golfer to get into the proper address position prior to using the training device, and therefore do nothing to aid the golfer to set up correctly in terms of the complete address position. Moreover, the prior art training devices do not seem to be specifically designed to help the golfer perform a proper one-piece take-away, nor assist the golfer to conceptualize the one piece take-away movement.

By contrast, embodiments of the present invention facilitate the correct body positioning relative to the golf club during the address position and during the golf swing take-away. The invention is based, at least in part, on present inventor's discovery that upon addressing the ball and during the take-away, professional golfers have a predictable and consistent angle between the centerline (in the elbow-to-wrist direction) of the leading forearm and the shaft of the golf club for most of their golf shots. This specification uses the symbol $\beta$ to refer to that angle, which is herein referred to as the shaft-to-forearm angle. The present inventor has determined that the above-mentioned shaft-to-forearm angle $\beta$ used by golf professionals for most of their shots is substantially 145 to 160 degrees. This specification uses the symbol $\beta_{opt}$ to refer to any angle substantially within this range.

Based on this discovery, training devices embodying the principles of the invention provide feedback to the golfer in the form of a human-perceptible stimulus when a predetermined shaft-to-forearm angle is adopted during address and take-away, thereby helping the golfer to conform his swing to a predictable and consistent shaft-to-forearm angle from one shot to the next. The value of the shaft-to-forearm angle desired by the learning golfer will typically be the angle $\beta_{opt}$, as just defined.

The illustrative training devices shown herein are in the form of a device that is held in place on the golf club, either by a physical device such as a clamp, or by the implementation of the present inventor's discovery that the present golf training aid, as well as possibly other golf training aids, can be held securely in place on a golf club primarily by hand pressure of the golfer upon gripping the golf club. The training device is so configured that upon its being put held in contact with a particular portion of the golf club—illustratively the golf club grip—a portion of the training device—illustratively a free end—contacts the underside of at least one of the forearms of the golfer upon the golfer achieving a desired shaft-to-forearm angle. In particular embodiments, the contact area is the golfer's leading forearm (i.e., the left forearm for a right-hand-swinging golfer, and vice versa), The contact with the golfer's forearm(s) provides a tactile sensation indicating that the golfer has, in fact, achieved the desired shaft-to-forearm angle. If the shaft-to-forearm angle were less than the desired amount, the training device would not contact the golfer's forearm, prompting him to increase the angle. If the shaft-to-forearm angle is greater than the desired amount, the training device will be exerting higher pressure on to, or digging in to the golfer's forearm, prompting him to decrease the angle.

It is generally recognized within the sport that the angular orientation between the longitudinal shaft axis to longitudinal spine axis as viewed from the side—referred to herein as the "shaft-to-spine angle"—should be approximately 90 to 100 degrees. The present inventor has discovered that upon a golfer being caused to set the shaft-to-forearm angle to $\beta_{opt}$ upon beginning to get into the address position with most any golf club, the golfer simply has to assume an address position with an athletic stance and the golfer's resulting spine-to-shaft angle in address will, in fact, be approximately 90 to 100 degrees, as desired. Thus the present training device helps the golfer achieve both a proper shaft-to-forearm angle and a proper shaft-to-spine angle at address. Having those angles be consistent for most of the clubs that a golfer swings, will increase the chance of properly swinging the golf club and properly striking the golf ball, and will help the golfer to more easily make corrections and adjustments to other components of the golf swing.

Particular embodiments of the training device are such that shaft-to-forearm angle is fixed at $\beta_{opt}$. Other embodiments, however, may be adjustable in such a way as to allow the golfer to select a shaft-to-forearm angle that is different from $\beta_{opt}$ and/or to select a particular desired contact location on the leading or trailing forearm. Such adjustability may be particularly useful for specialty shots such as a putting stroke and/or to adjust the training device to match, for example, the idiosyncrasies of the golfer's body. Embodiments having this adjustable feature may have markings, detents or other means that enables the golfer to readily set the shaft-to-forearm angle to $\beta_{opt}$ should that be the golfer's selection.

As suggested above, there are at least two ways in which the training device may be held in fixed relation to the golf club when in use. One way is to clamp or otherwise secure the training device to the club so that that the device will remain attached to the club when the club is not being held by a golfer. However, in particular embodiments, the device may not actually attach to the club but, rather, may have an interface that can be placed up against the club, with the interface being configured in such a way that the device will not remain in contact with the club unless held in place by and under the golfer's hand(s) or by other means external to the device itself. There are a number of benefits to the latter approach, as described hereinbelow. This aspect of the present inventor's contribution is applicable to golf training aids other than those shown and described herein. This aspect of the invention, therefore, encompasses a golf training aid having an interface that holds the golf training aid in contact with a golf club primarily by hand pressure.

Particular embodiments of the training device may be foldable and/or collapsible so as to allow it to be put into a more compact configuration for storage or transport A further aspect of the present invention is a method performed by a golfer in which a device is positioned in contact with a golf club wherein the device provides a human-perceptible stimulus to the golfer responsive to the shaft-to-forearm angle $\beta$ between the centerline of a forearm of the golfer and the shaft of the golf club being a predetermined value.

DETAILED DESCRIPTION OF ILLUSTRATIVE EMBODIMENTS

Theoretical Underpinnings

Figure 1:
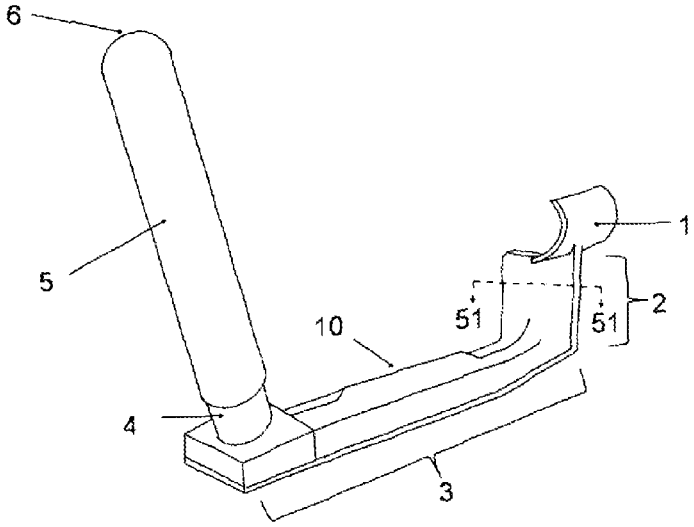
FIG. 1 is a perspective view of one embodiment of a training device implementing the present invention.

A golf swing is a task that is composed of a complex series of positions and movements that are all interrelated. The ability to help a golfer consistently isolate and properly set, one or more of the positions or movements for most of the golf clubs they swing, would simplify the task of properly swinging the clubs, and quicken the golf swing learning curve. By notifying the golfer when s/he has set a position properly and allowing a golfer to easily maintain a single component of a properly executed golf swing from swing to swing, the remaining components can be more easily executed and mastered, while the single component can at the same time be mastered thru repetition and muscle memory.

The present inventor has recognized that a drawback of the prior art training devices is that they are not intended to train the golfer to achieve the proper positions as viewed from the side of the golfer including the shaft, forearm and spine orientations relative to the body and each other, nor to achieve a proper complete address and take-away position. Most rely on the golfer to get into the proper address position prior to using the training device, and therefore do nothing to aid the golfer to set up correctly in terms of the complete address position. Moreover, the prior art training devices do not seem to be specifically designed to help the golfer perform a proper one-piece take-away, nor assist the golfer to conceptualize the one piece take-away movement.

By contrast, embodiments of the present invention facilitate the correct body positioning relative to the golf club during the address position and during the golf swing take-away. The invention is based, at least in part, on the present inventor's discovery that upon addressing the ball and during the take-away until the shaft is approximately parallel to the ground, professional golfers have a predictable and consistent shaft-to-forearm angle between the leading forearm and the shaft of the golf club for most of their golf shots. Further, the shaft-to-forearm angle is directly related to, and has a linear relationship with, the user's wrist deviation in the ulnar and radial direction because the golf club is held by and oriented to the users hand. This specification uses the symbol $\beta$ to refer to the shaft-to-forearm angle. The present inventor has determined that the above-mentioned shaft-to-forearm angle $\beta$ used by golf professionals for most of their shots is substantially 145 to 160 degrees. This specification uses the symbol $\beta_{opt}$ to refer to any angle substantially within this range.

The reason that the shaft-to-forearm angle and the associated deviation of the wrist is predictable and consistent for a professional, is likely due to the professional knowing and recognizing the feeling of how much to bend the knees, how much to lean forward, and how to angle the arms relative to the shoulders and body, and knowing that these positions have consistently produced good golf swings in the past. For an amateur, achieving a proper and a consistent angular orientation between the shaft axis and spine axis, as viewed from the side, in conjunction with the remaining elements, is extremely difficult because of the necessity to properly execute all the individual components which are interrelated, and repeat these positions for the other clubs that the golfer swings. The present inventor has discovered that if a golfer can set a proper angular orientation between the longitudinal shaft axis to longitudinal forearm axis as viewed from the side, prior to getting into the address position for each club, the golfer simply has to assume an athletic stance, bend at the waist until the golf club touches the ground, and the golfer's resulting angular orientation between the longitudinal shaft axis and longitudinal spine axis at address will be approximately 90-100 degrees, and the golfer will more consistently achieve a proper and more effective golf swing address position. Further, the present inventor has discovered that if the golfer maintains this shaft-to-forearm angle during the first part of the back swing until the shaft is approximately parallel to the ground, the golfer will execute a more effective shoulder turn, and will more consistently complete a proper back-swing and will more consistently execute a proper golf swing.

Based on this discovery, training devices embodying the principles of the invention provide feedback to the golfer when a desired shaft-to-forearm angle is adopted during address and take-away, thereby helping the golfer to conform his swing to a predictable and consistent shaft-to-forearm angle from one shot to the next. The shaft-to-forearm angle desired by the learning golfer will typically be the angle $\beta_{opt}$, as just defined.

This is accomplished by providing feedback to the golfer when a correct body position relative to the golf club is achieved. By isolating and setting or holding constant a particular one component of a properly executed golf swing, the remaining components can be more easily executed and mastered while that one component can at the same time be mastered thru repetition.

The sequence of movements that a golfer will go through when using a training device embodying the principles of the present invention to swing a golf club is summarized as follows: When the golfer has positioned the shoulders and feet in the proper orientation relative to the desired ball trajectory, the device can be moved into the proper position relative to the leading forearm by bending the wrist—specifically by adjusting the wrist radial/ulnar deviation—so that a tip of the device—illustratively the tip of the flexible member of the illustrative embodiments as described hereinbelow—will contact the underside of the leading forearm, which will result in desired shaft-to-forearm angle to $\beta_{opt}$. The golfer will then allow the arms to pivot from the shoulders moving the hands lower, and allowing the arms to hang, and then bend the knees, and lean forward slightly until the golf club head touches the ground, while being sure to maintain a balanced stance. At this point when the golfer's address to the ball is set, the spine-to-shaft angle will be set at an angle of approximately 90-100 degrees, and the shaft-to-forearm angle will be maintained at $\beta_{opt}$. After the golfer has assumed the address position, the golfer will begin the golf swing by essentially rotating the torso about the spine axis, keeping both arms relatively straight. The golfer will keep the tip of the training aid in the same position on the forearm during the take-away, which will maintain the shaft-to-forearm angle. Once the arms and shoulders are rotated around the spine to the proper position for the desired shot—typically when the shaft is parallel to the ground—the wrists will be broken, and the contact between the tip and the forearm is broken which will give tactile feedback. The tactile feedback will allow the golfer to recognize exactly at what point the shaft-to-forearm angle changes, and make the necessary corrections if needed to fine tune the swing to the desired swing type. Maintaining the shaft-to-forearm angle during the first part of the swing encourages proper shoulder rotation and proper swing arc, which will generate more club head speed at impact, resulting in longer golf shots and will further teach the golfer to perform this movement consistently. On the downswing the training aid will not be in contact with the golfer's forearm until the wrists are rotated enough to move the tip of the training aid into contact with the leading forearm. When the tip contacts the leading forearm, the golfer will feel the tip which will give way so as not to disrupt the swing, and will know that the shaft has moved into this position and will be given an indication of the shaft-to-forearm angle when the golf ball is struck. This tactile feedback will help the golfer to learn when to break the wrists on the downswing in order to contact the ball at different points during the swing, which will cause the club head to strike the ball in different ways. This ability is critical to imparting certain flight characteristics on the golf ball, and a skill that has in the past typically been very difficult to develop without a lot of training.

EMBODIMENTS

Similar reference characters are used throughout several drawings, and indicate corresponding parts. Dimensions and sizes of certain parts as shown in the drawings are modified or exaggerated for the purposes of clarity of illustration.

Figure 2:
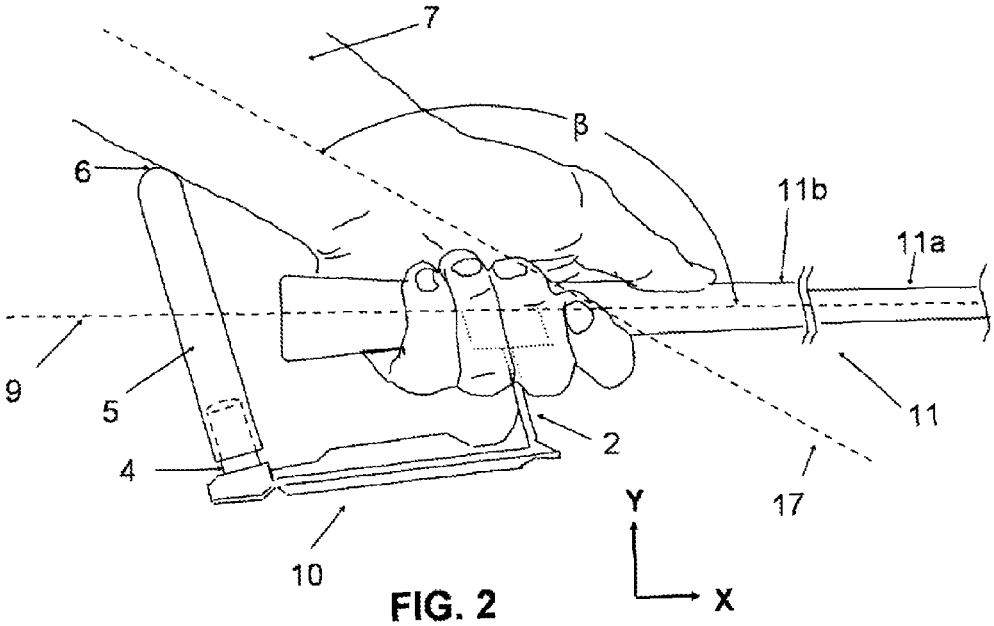
FIG. 2 is a side perspective view of the training device showing the training device in place on a golf club.
Figure 3:
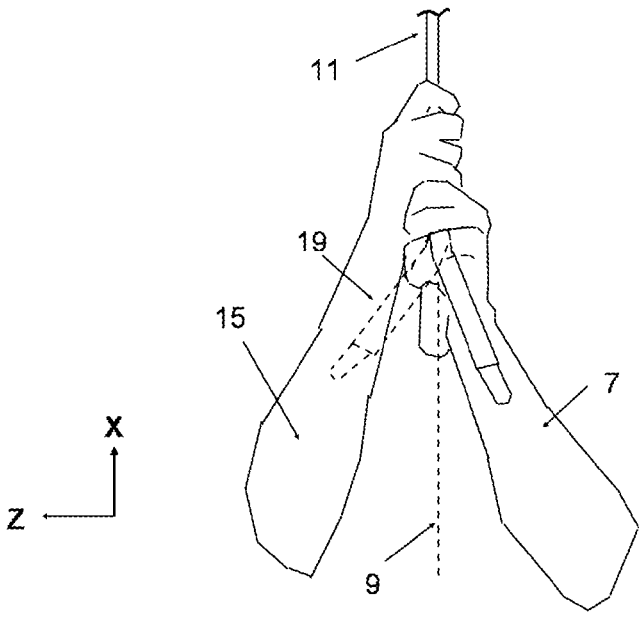
FIG. 3 is a bottom perspective view of the training device and also showing the underside of the golfer's forearms.

FIG. 1 is a perspective view of the first embodiment of the present invention intended to be held in fixed relation to a golf club 11 by the golfer's hand when gripping the club. FIGS. 2 and 3 are perspective views showing the golfer's forearms and hands grasping golf club 11 and the training device held in fixed relation to the golf club with the golfer in the address position, i.e., in the position just prior to the golfer beginning to pull the club back away from a golf ball to be hit. FIG. 2 is a view looking toward the side of the golfer and FIG. 3 is a view looking from below the golfer's arms. For clarity the right hand of the golfer is not shown in FIG. 2.

Figure 4:
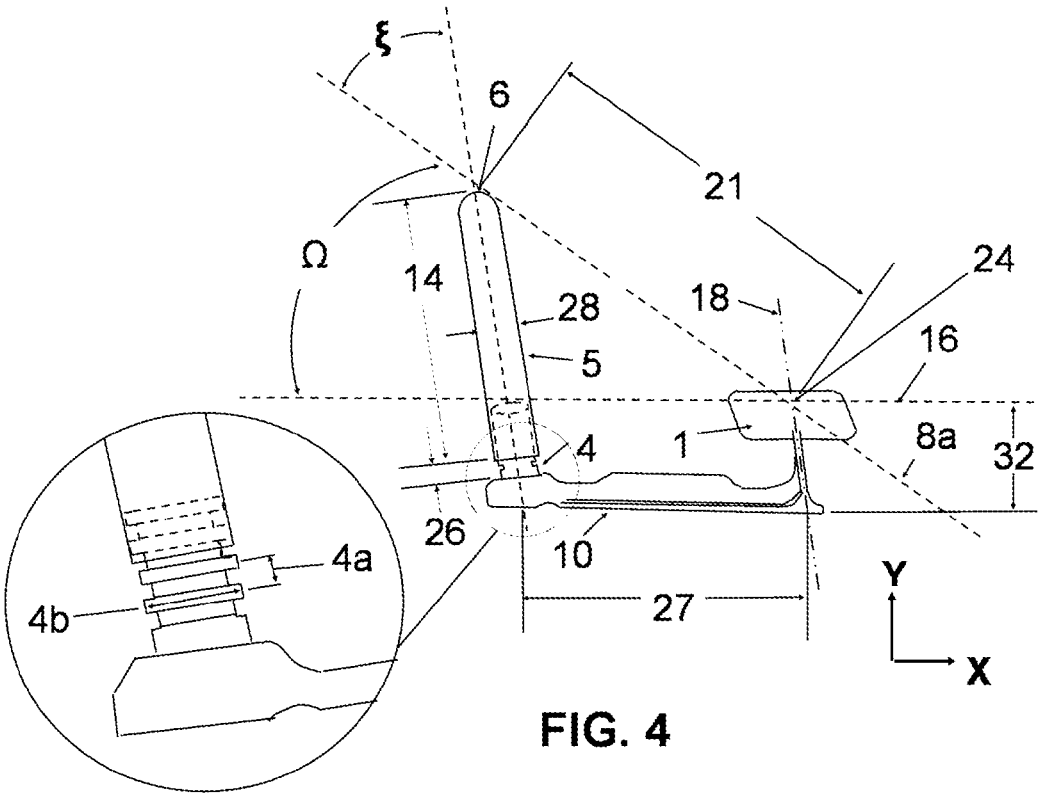
FIG. 4 is a side perspective view of the device of FIG. 1 useful in defining a particular angle $\Omega$.

The training device includes a guide member 10 that includes an interface 1 to be held in place on the shaft 11*a* of golf club 11 on grip 11*b* of the club, or further down the shaft toward the club head. Guide member 10 further includes an inter-finger portion 2 extending away from interface 1 and thus extending away from the axis 9 of golf club 11, when interface 1 is held in place in fixed relation to shaft 11*a*. Guide member 10 further includes a connecting member 3 that extends in a direction away from inter-finger portion 2 and thus, when in use as shown in the FIGS, in the general direction of the golfer. A support member 4 extends in the direction away from guide member 10 toward the forearm at typically 100 degrees. Support member 4 supports a tactile feedback member 5 that has a tip 6 for contact with the forearm, illustratively the leading forearm 7 of the golfer. Member 4 includes circumferential notches to allow the flexible member 5 to be moved into precise specific locations on member 4 as shown in FIG. 4, thereby adjusting the distance between the tip 6 at the free end of the flexible member 5 and connecting member 3. Changing the location of member 5 on member 4 will change the resulting angle Ω, which will therefore result in a different shaft-to-forearm angle β when the training device is held in fixed relation to the golf club and the golfer has adjusted his wrist in such a way that tip 6 is gently touching the underside of his forearm.

Figure 6:
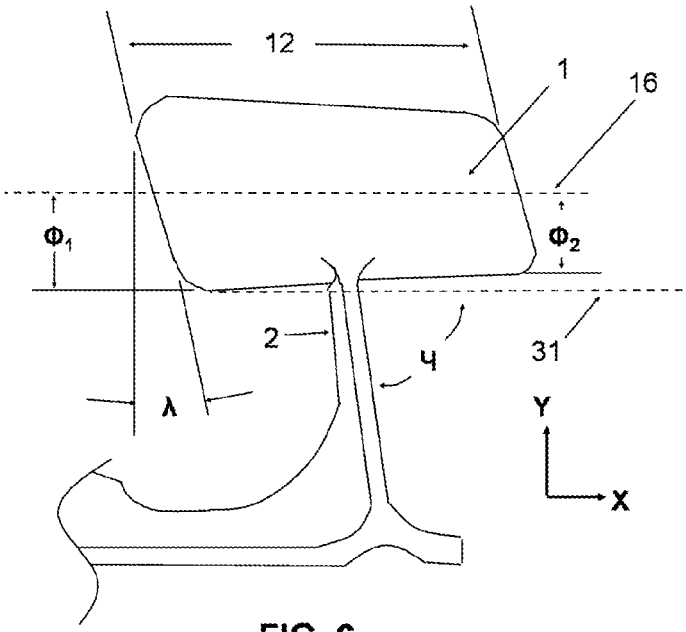
FIG. 6 shows details of an illustrative implementation of the training-device-to-golf-club interface of the embodiment of FIG. 1 of the present invention illustrating the interface attachment means and inter-finger portion.
Figure 7:
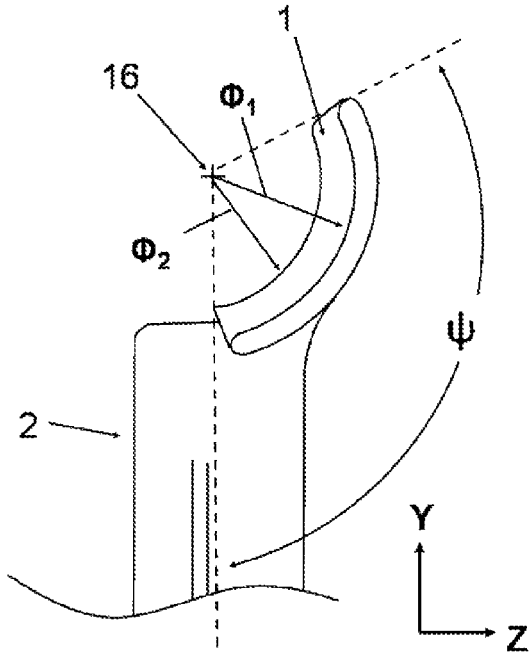
FIG. 7 is a side perspective view of the illustration in FIG. 6 rotated 90 degrees about the Y axis.
Figure 8:
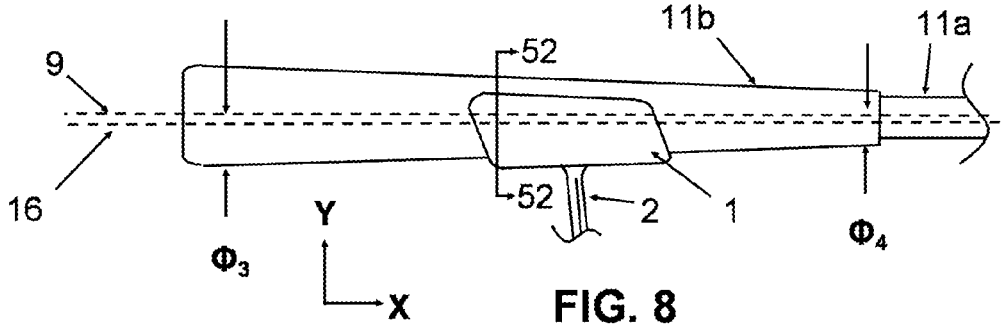
FIG. 8 is a side perspective view of the attachment means section in place on a golf club shaft showing the relationship between the interface arc axis and the golf club longitudinal axis.
Figure 9:
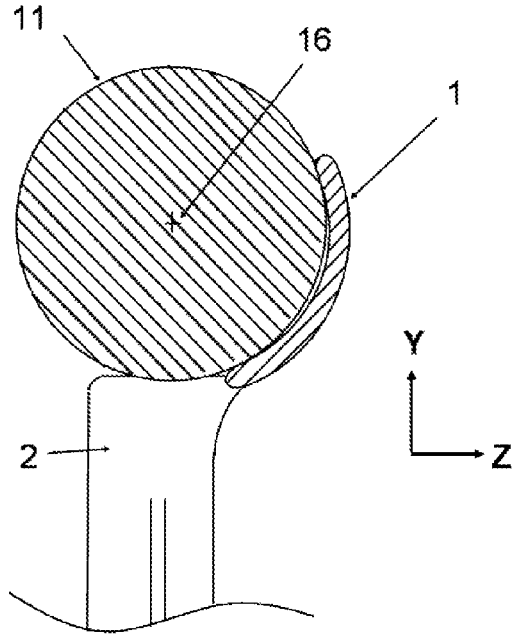
FIG. 9 is a section view of the device of FIG. 8.

When the training device of FIG. 1 is in use, interface 1 is kept in secure contact with grip 11*b* by means of hand pressure exerted by the golfer when the club is being held. The inner surface of interface 1 is illustratively a partial surface of a cone. Thus as shown in FIGS. 6 and 7, the club interface 1 has an arc radius that varies linearly between values $\phi_1$ and $\phi_2$, corresponding to the linearly varying radius of the golf club grip 11*b* along axis 9 as shown in FIG. 8. A typical golf club grip 11*b* has a radius ranging from typically 0.53 inches to typically 0.347 inches from the largest end $\phi_3$, to the smallest end $\phi_4$ as shown in FIG. 8. Illustratively, $\phi_1 \cong 0.425$ inches and $\phi_2 \cong 0.395$ inches. Those values of $\phi_1$ and $\phi_2$ account for, and enable a secure contact to be maintained with, the varying radius of the golf club grip. Those values of $\phi_1$ and $\phi_2$ also, enable interface axis 16 to be oriented in such a way as to be substantially collinear to the shaft axis regardless of the location that the interface is positioned along the golf club grip 11*b* throughout the golf swing and allow the interface to maintain adequate contact with, and maintain its orientation to, the golf club 11 throughout the golf swing. As illustrated in FIG. 9, contact between the golf club grip 11*b* and interface 1 is primarily along the edges of the interface 1 depending on location along the grip. Although not the preferred embodiment, the inner surface of interface 1 might alternatively be a partial surface of a cylinder with an arc radius of about 0.400 inches, or multiple surfaces that are positioned in a pattern and location that will contact the golf club along the golf grip 11*b* outer surface.

Figure 10:
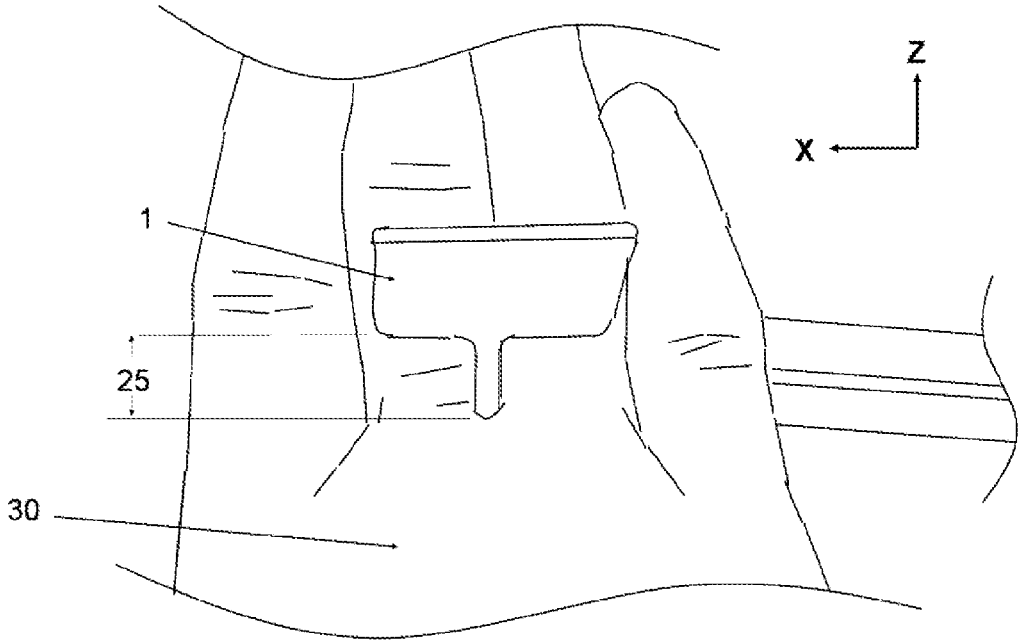
FIG. 10 is a top perspective view of the training device and also showing part of a hand.

Inter-finger element 2 will fit between two of the golfer's fingers—illustratively the middle and ring fingers—and extends in a direction generally perpendicular to and away from the golf club shaft 11*a* for a distance sufficient to keep the remainder of the training device from contacting the hands of the user so that it will not interfere with the users hands during the swing. Inter-finger element 2 is designed to fit within the contour of the space between adjacent fingers of a hand of the golfer when the golfer is using that hand to hold interface 1 in contact with the grip of the golf club. When the end of inter-finger element 2 is resting at the base of the fingers as shown in FIG. 10, the bottom edge of the interface 1 is positioned a distance away from the base of the fingers 25, typically 0.40 inches, so that when the interface 1 is subsequently gripped by the golfer and held in fixed relation to golf club grip 11*b* as shown in FIG. 1, the golf club grip 11*b* will be in a position relative to the palm and fingers of the hand, that is considered within the golf industry as a good grip position. Further, embodiments of the invention are designed such that if the inter-finger element is resting at the base of the fingers during the address position, and the contact tip 6 is contacting the underside of the golfer's forearm, then the golfer's hand will likely be positioned properly relative to the golf club head striking face in terms of the back side of the leading hand being parallel to the bottom edge of the golf club head striking face.

Figure 5:
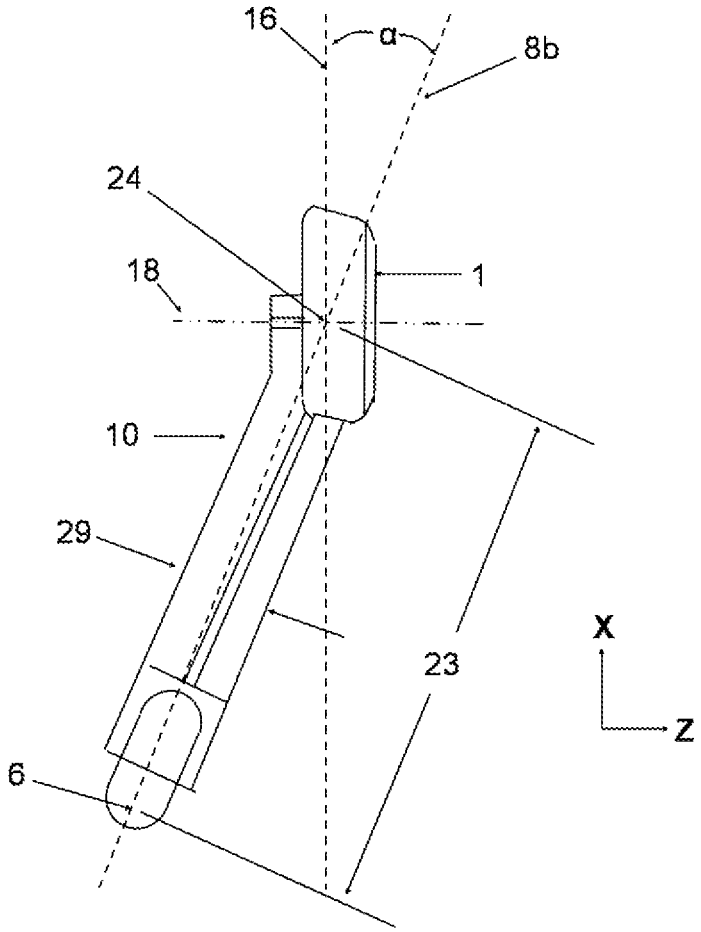
FIG. 5 is a top perspective view of the device of FIG. 1 useful in defining a particular angle $\alpha$.
Figure 20:
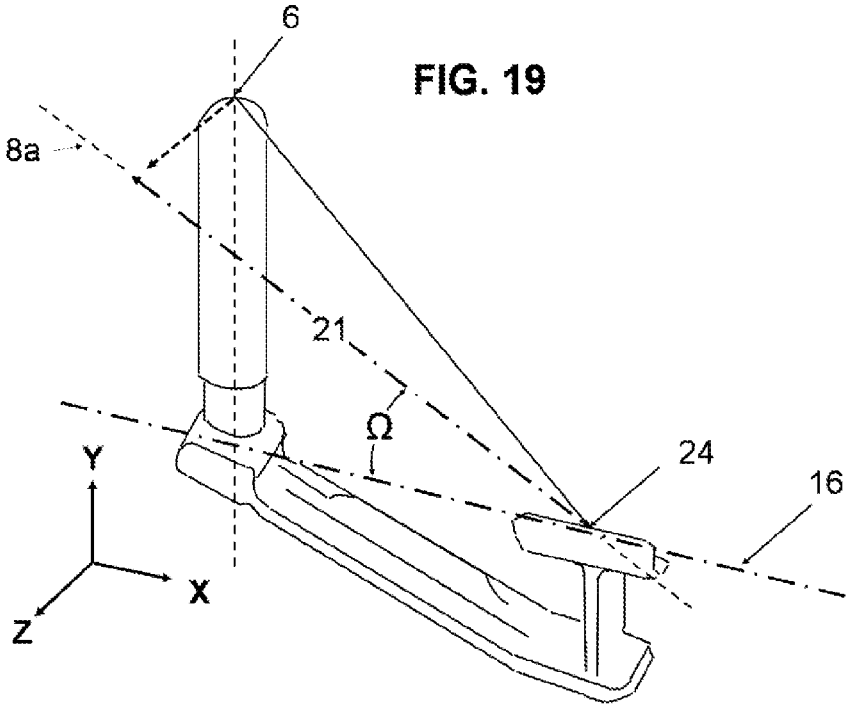
FIGS. 20-23 are drawings helpful in explaining certain aspects of the construction of the embodiment of FIG. 1.
Figure 22:
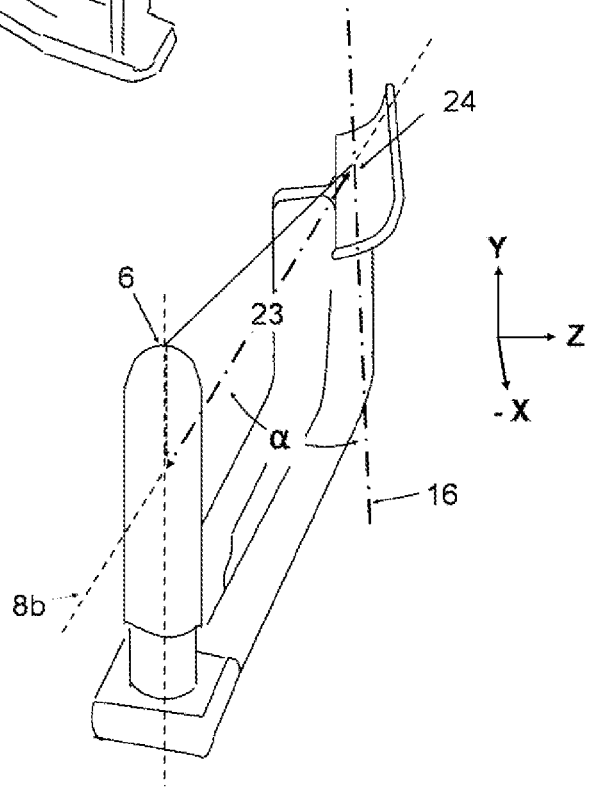

Attention is directed to the angles Ω shown in FIGS. 4 and 20, and a shown in FIGS. 5 and 22, and dimensions 21 and 23 shown in FIGS. 4, 5, 20 and 22. When these dimensions and angles are at particular values for the particular embodiment depicted, the golfer will achieve a shaft-to-forearm-angle $\beta_{opt}$ when the training device is held in fixed relation to the golf club and the golfer has adjusted his wrist in such a way that tip 6 is gently touching the underside of his forearm.

As shown in FIGS. 4 and 20, the angle Ω is defined as the angle between the arc radius centerline axis 16 of interface 1, and axis 8*a*. Axis 8*a* is the projection of a line passing through the tip 6 and point 24, onto plane X-Y, as viewed in FIGS. 4 and 20. Point 24 is the point where the arc radius centerline axis 16 intersects with plane 18. Plane 18 is an imaginary plane residing in the Y-Z plane, that contains inter-finger portion 2, as illustrated in FIGS. 4 and 5. Typical value for Ω is 40 degrees+/−5 degrees. Length 21 is the length of axis 8*a* between tip 6 and point 24, as illustrated in FIGS. 4 and 20. Length 21 is typically 5.2 inches+/−0.25 inches.

Figure 21:
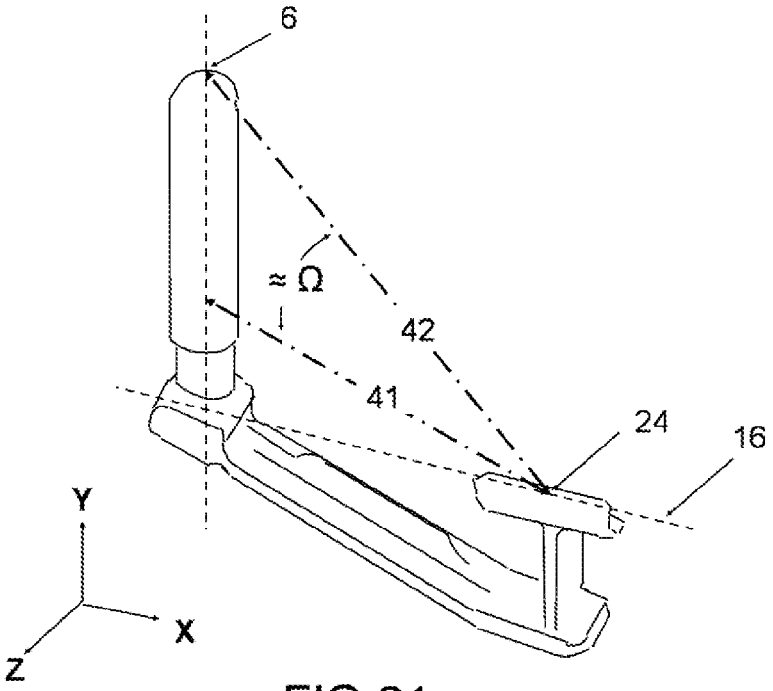

As shown in FIG. 21, angle Ω can, to a good approximation, be alternatively defined as the angle between a) the shortest line between point 24 and tactile feedback member 5, denoted 41, and b) a line 42 passing through tip 6 and point 24.

As shown in FIGS. 5 and 22, the angle α is defined as the angle between the arc radius centerline axis 16 of interface 1 and axis 8*b*. Axis 8*b* is the projection of a line passing through the tip 6 and point 24, onto plane X-Z, as viewed in FIGS. 5 and 22. Typical value for α is 16 degrees+/−5 degrees. Length 23 is the length of axis 8*b* between tip 6 and point 24, as illustrated in FIGS. 5 and 22. Length 23 is typically 3.85 inches+/−0.25 inches. When the training device is held in place on the golf club, the arc radius centerline axis 16 is substantially collinear with golf club shaft axis 9 as illustrated in FIG. 8.

Figure 23:
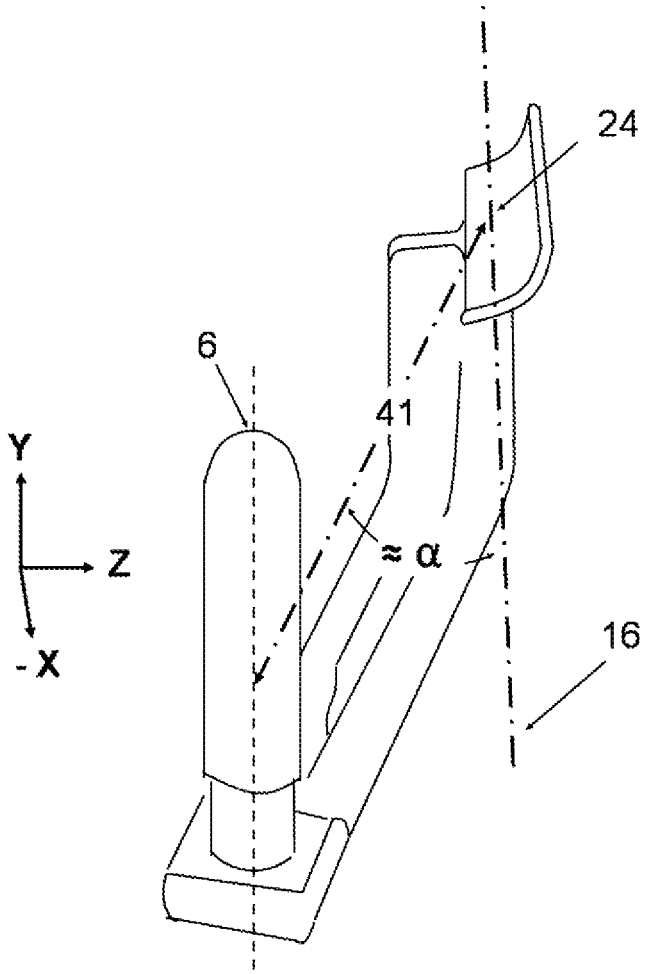

As shown in FIG. 23, angle α, can, to a good approximation, be alternatively defined as the angle between a) the shortest line between point 24 and tactile feedback member 5, denoted 41, and b) arc radius centerline axis 16.

Figure 1A:
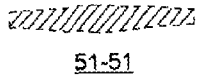
FIG. 1*a* is a section view of the device of FIG. 1.

Club interface 1 is designed in such a way so as not to significantly interfere with the golfer's standard grip, allowing the golfer to have a firm hold on the golf club. This characteristic of club interface 1 is a result of the interface's design, including an arc shape similar to the golf club grip, a thin profile, and a length 12 along the grip 11*b*, as illustrated in FIG. 6, that will be as small as possible to limit interference with the golfer's grip while providing enough contact to insure that the training device does not slip or move during the execution of the golf swing. The arc shape has a radial arc angle, ψ, as illustrated in FIG. 7. Arc angle, ψ is less than 180 degrees so that hand pressure is required to keep the device in place. Arc angle, ψ is typically between 100 and 120 degrees. The inter-finger section 2 is designed to fit between the fingers of the golfer when a standard grip is taken by the golfer and has a cross section similar to H-H, illustrated in FIG. 1*a*, that fits comfortably between the bottom two knuckles so that there is limited disruption of the golfer's grip as compared to a grip without using the training device. The inter-finger section 2 is designed to have maximum thickness within the design envelope, in order to maximize the strength of the section. Typical thickness at the thickest location in section H-H is 0.14 inches. Club interface 1 has angled edges at an angle λ as projected onto the X-Y plane, as seen in FIG. 6, to keep the interface substantially parallel to the user's middle and ring fingers in that area when the device is being used. Typical value of λ is 4 to 6 degrees. The member section 2 is oriented at angle Ч, , relative to line 31 which is parallel to the interface 1 centerline axis, as projected onto the X-Y plane as seen in FIG. 6. The angle Ч, is designed to match the orientation and location of the user's fingers when the device is being used. Typical value for Ч, is 80 to 85 degrees. Club interface 1 may have a contoured outer surface to match the contours of the finger surfaces to further limit any disruption of the golfer's grip.

Some typical dimensions of the first embodiment are detailed in FIG. 4, and are as follows. ξ is the angle at which members 4 and 5 protrude from member section 3, relative to axis 8*a*, and is approximately 35 degrees. The length of member 5, defined as 14, is approximately 4.35 inches long. The length 26 of the portion 4 of member 5 that is exposed with two ridges showing is approximately 0.30 inches. Ridge spacing, 4*a*, is typically 0.15 inches. The width of member 5 is defined as 28, and is approximately 0.60 inches. The distance from the base of member 2 to the base of member 4 is defined as 27, and is approximately 3.60 inches. The distance from the arc radius centerline 16 to the base of member 2 defined as 32, and is approximately 1.98 inches. The diameter of member 4 at the outer ridge location, 4*b*, is typically 0.55 inches Some additional typical dimensions of the first embodiment are detailed in FIG. 5. The width of member section 3 is defined as 29, and is typically 0.79 inches.

Figure 11:
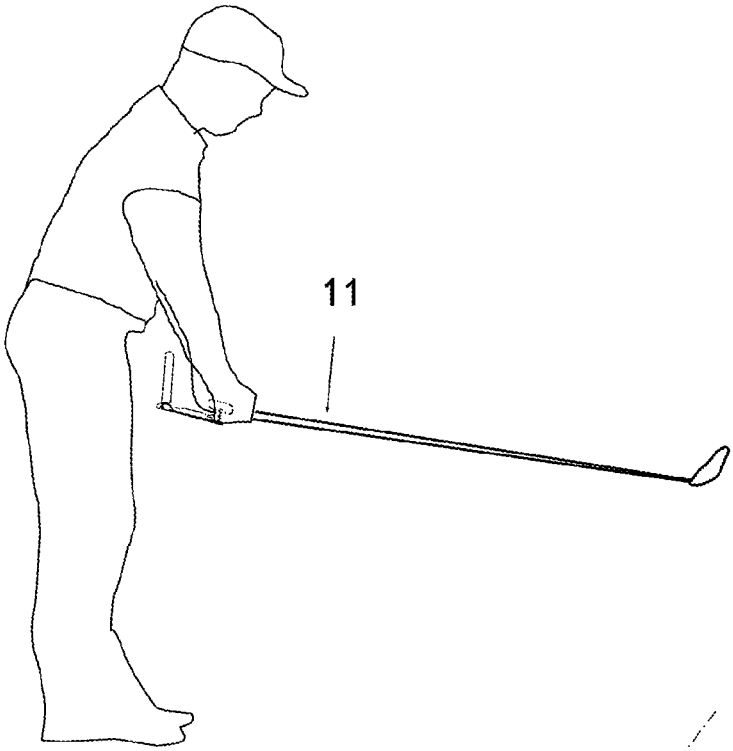
FIG. 11 is a side perspective view of the golfer prior to setting the shaft-to-forearm angle.
Figure 12:
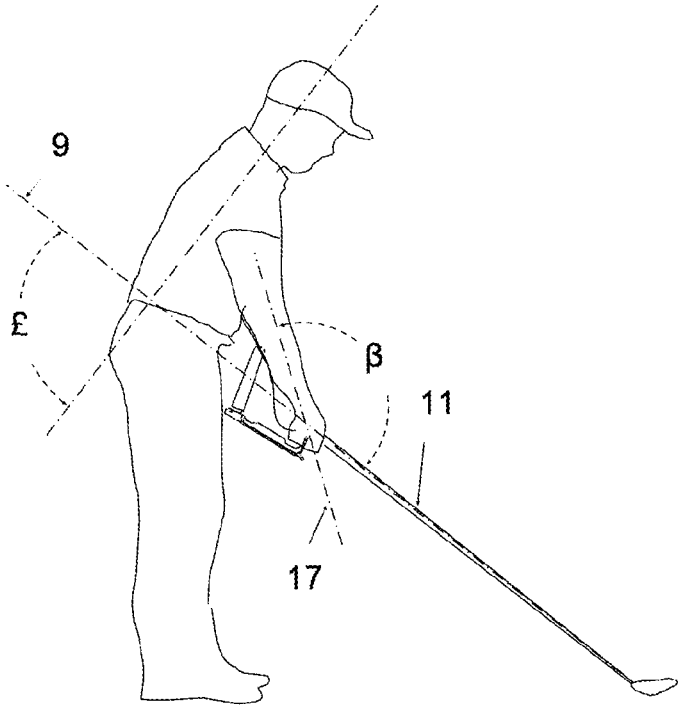
FIG. 12 is a side perspective view of the golfer in an address position using the training device.

FIG. 11 illustrates the training device held securely to the golf club prior to the golfer setting shaft-to-forearm angle β to the value imposed by the training device. When the golfer is in this position, the golfer can adjust the club head hitting surface radial orientation relative to the training device by rotating the club about its longitudinal axis. The golfer then sets the shaft-to-forearm angle β to the optimal shaft-to-forearm angle $\beta_{opt}$, and then bends the knees and lowers the arms until the club head touches the ground. At this point as illustrated in FIG. 12, the golfer will be in the address position.

Figure 13:
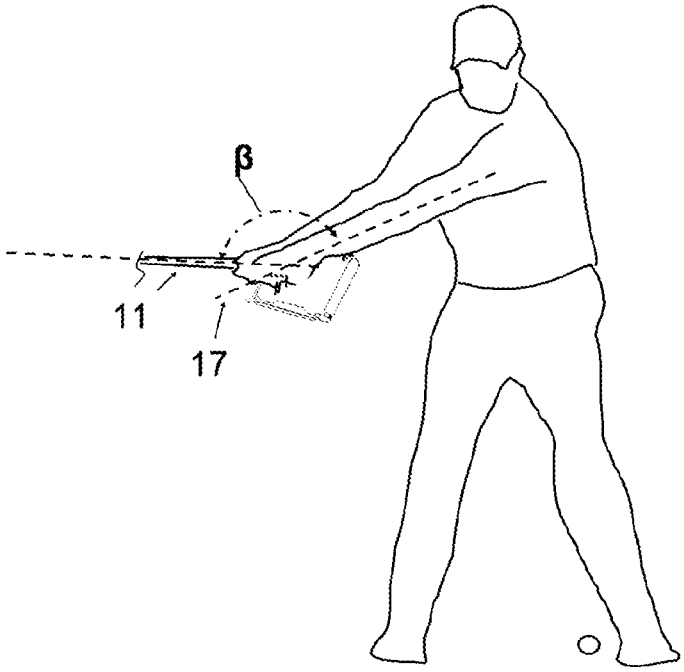
FIG. 13 is a front perspective view of the golfer in the take-away position prior to breaking the wrists.

FIG. 13 illustrates one of the functions of the present invention related to the swing take-away. As the golfer begins the golf swing after using the tactile feedback provided by the device to set the shaft-to-forearm angle β at address to $\beta_{opt}$, that angle is maintain during the take-away until the point in the swing at which the golfer rotates the wrists and thereupon breaks contact between the tip 6 and leading forearm 7. The device will not contact the forearm for the remainder of the backswing and the first part of the downswing.

Figure 14:
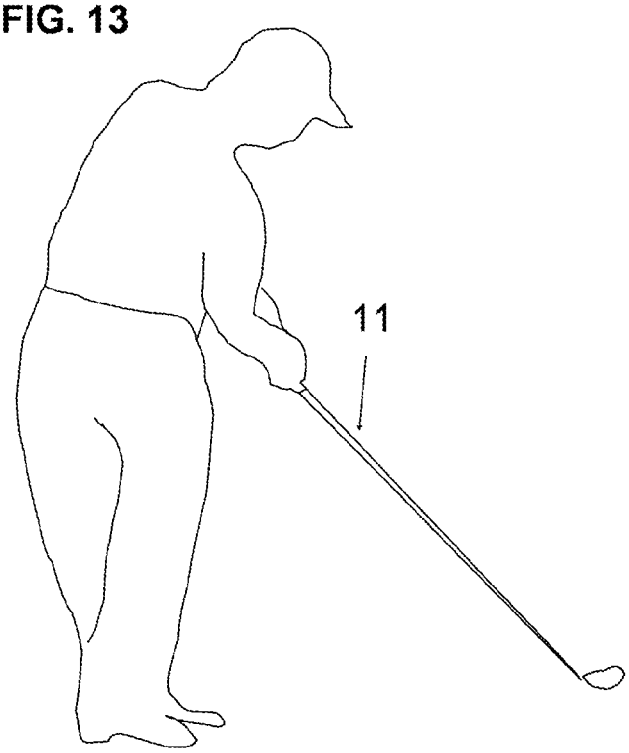
FIG. 14 is a side perspective view of the golfer in a position at the time of impact of the golf club head with a golf ball.

It is desirable for tactile feedback member 5 to deflect relative to the training device as a whole at the point in the downswing when a lateral force is applied to the tactile feedback member 5 upon its contacting the leading forearm 7 as illustrated in FIG. 14. To this end, tactile feedback member 5 may be made out of flexible material, such as rubber or foam rubber, or designed as a rubber cylinder with a closed end. A flexible tactile feedback member 5 flexible enough to allow it's present function, does not apply significant force to the forearm when tactile feedback is given, nor does it significantly interfere with the swing. Alternatively, tactile feedback member 5 may be a rigid member with a spring loaded joint located at the base of the member.

There are a number of benefits resulting from the training device being held in place by the golfer's hand(s) as opposed to being secured by a clamp or the like, making this a particularly advantageous feature. Firstly, this feature makes it more convenient, and less obtrusive and not at all time-consuming to alternate one's use of the device among multiple clubs, as compared to having to disengage the training device from one club and re-engage it on another. On the golf course, having to take time to attach a device to a club is cumbersome, and golfers may be less likely to actually use the devices while on a golf course because they do not wish to be seen attaching a device or been seen using non-standard clubs, or simply because it is a hassle to attach and remove.

Yet another advantage is that since the training device is held in place under the golfer's hands, the present training device changes how the swing feels to the player to a much lesser extent than if it were attached at, say, a point beyond the hands of the golfer, thereby adding mass to the club at a point along the shaft that might make the swing feel different due to the change in the resulting moment of inertia of the golf club and device.

Yet another advantage is that the interface can be easily designed, by the virtue of the varying arc radius $\phi_1$ to $\phi_2$, to allow the point at which the training device can be held in place at different points along the golf club grip, enabling the golfer to 'chock up' when desired while still using the device.

Yet another advantage is that, unlike some prior art devices, the present training device does not interfere with, or force particular body or arm positions during, a golfer's normal swing, nor does it prevent the golfer from taking a full, relatively undisrupted swing in the same way as a swing without the device.

Figure 15:
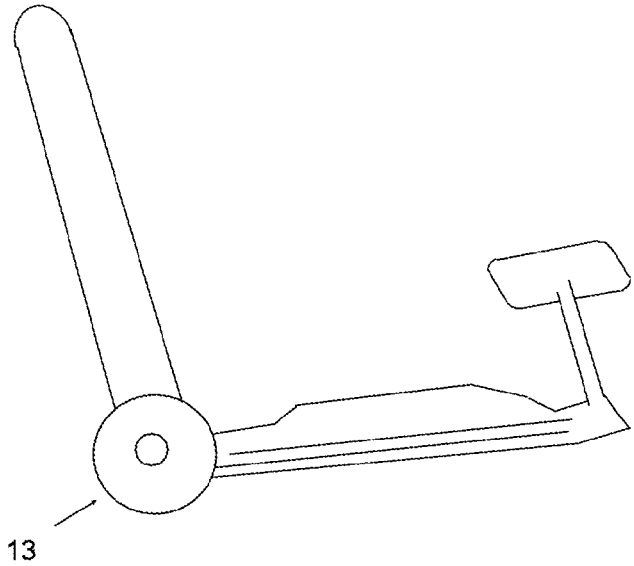
FIGS. 15-16 are perspective views of respective other embodiments of a training device embodying the principles of the present invention.

A further embodiment of a training device embodying the principles of the present invention is shown in FIG. 15. This embodiment is similar to that shown in FIG. 1 except that that the training device of FIG. 15 includes an adjustment ball and socket type joint 13 that allows the golfer to change the angles $\Omega$ and $\alpha$, and the corresponding angle $\beta$, at address. The adjustment joint allows for changing angle $\beta$ for certain specialty shots including the putting stroke with a putter. It also allows the golfer to change the contact point on the forearm, change the golfer's preferred address angles, or to have the tip contact the user's trailing forearm 15 as shown in FIG. 3. The device contacting the trailing forearm is illustrated with dashed lines 19 in FIG. 3. A golf swing training device embodying the principles of this invention can have any type of joint or combination of joints or location of joint that will allow changing of the design angles.

Figure 16:
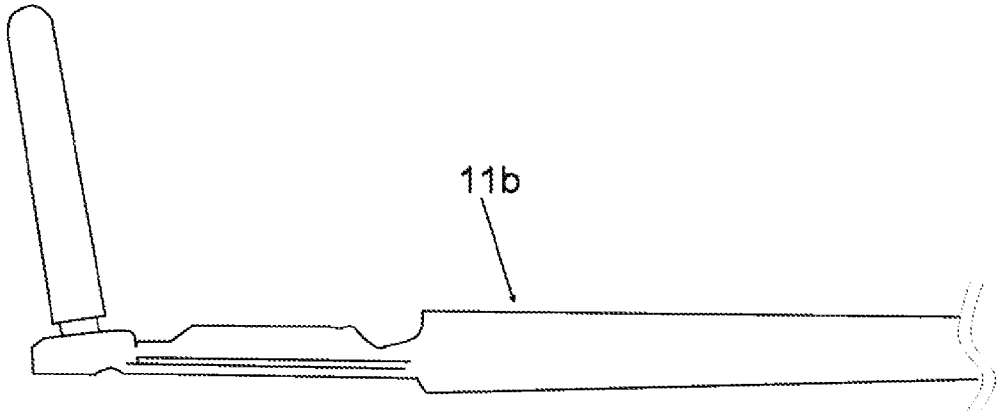

A further embodiment of the present invention is shown in FIG. 16. This embodiment is similar to that shown in FIG. 1 except that that the training device is permanently attached to the golf club, such as by being embedded in the end of the shaft, as shown in FIG. 16. The training device could, in fact, be designed to be attached or integrated at any location on the golf club.

Figure 17:
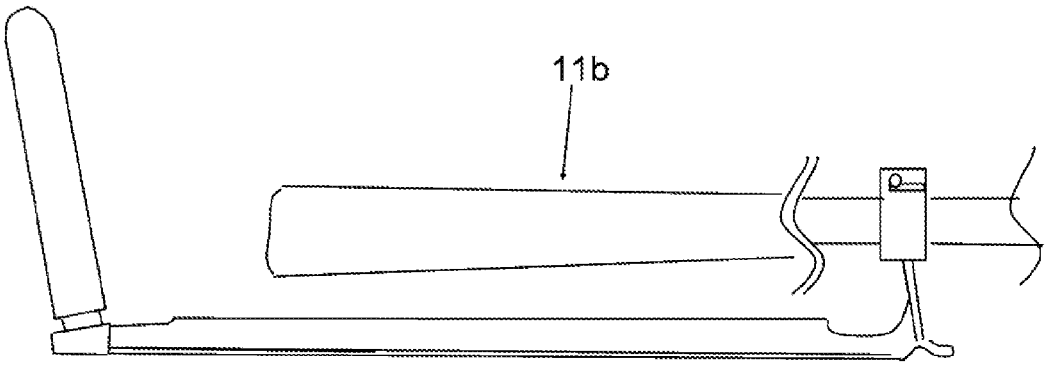
FIG. 17 is a perspective view of another embodiment of the present invention.
Figure 18:
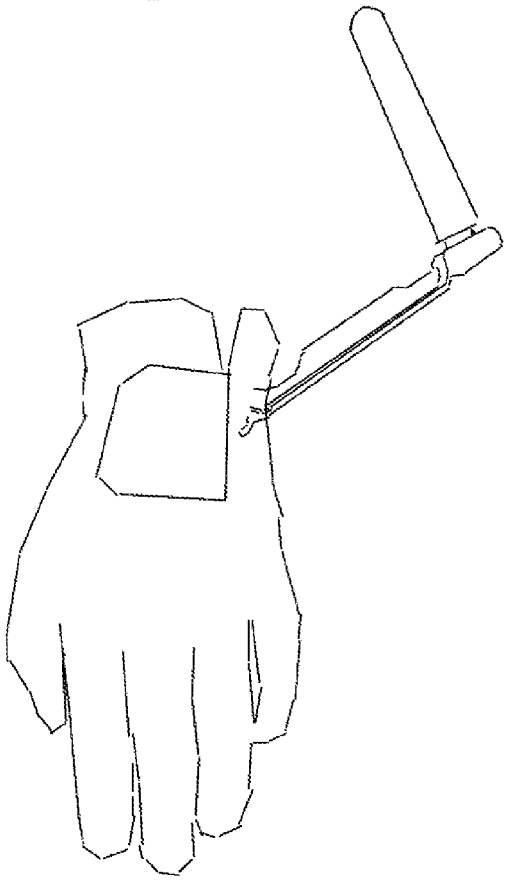
FIG. 18 is a perspective view of another embodiment of the present invention.

A further embodiment of the present invention is shown in FIG. 17. This embodiment is similar to that shown in FIG. 1 except that in the training device of FIG. 17 the club interface is removably affixed to the golf club, such by means of a clamp as shown in FIG. 17, thereby allowing removal of training device for use on multiple golf clubs. The training device could be attached at any point on or below the golf club grip. Another embodiment of the present invention is shown in FIG. 18, which illustrates the training device integrated with a glove that would be worn on the golfer's leading hand.

Figure 19:
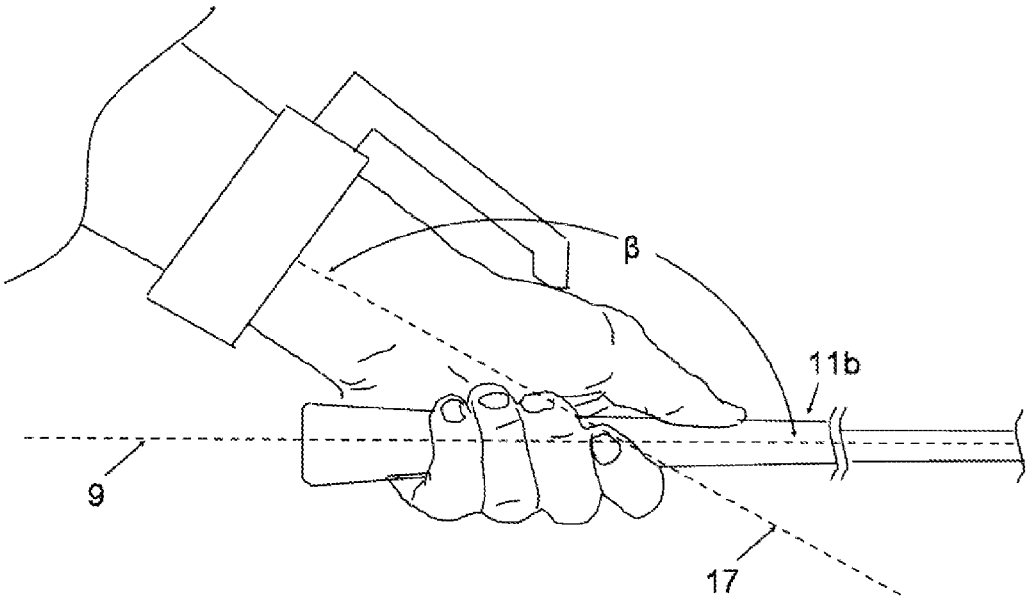
FIG. 19 is a perspective view of another embodiment of the present invention.

A further embodiment of the present invention is shown in FIG. 19. In this embodiment the device is held in fixed relation to the user's forearm, with a flexible member that contacts the user's hand when a wrist radial deviation or shaft-to-forearm angle $\beta$ is achieved.

The foregoing merely illustrates the principles of the invention and numerous variations are possible.

For example, a golf swing training device embodying the principles of this invention can have any desired configuration of the interface and guide member sizes shapes and orientations, to locate the contact tip 6 in a location that will create particular values of angles $\Omega$ and $\alpha$, and dimensions 21 and 23, that will ultimately allow a golfer to use the training device to achieve multiple values of the shaft-to-forearm angle $\beta$, or multiple values of the wrist radial or ulnar deviation, during the address position.

Moreover, for embodiments in which the training device is to be secured to the golf club, this can achieved by various means, such as by clamping or screw pressure, permanent attachment to the golf club, or attached to the end of the grip via a form-fitting cap type of interface that fits over the butt end of the shaft.

Moreover, a golf swing training device embodying the principles of this invention could include a device that is not oriented or used in conjunction with a golf club, but is used in itself to practice the feeling of achieving a desired a shaft-to-forearm angle $\beta$, such as the angle $\beta_{opt}$.

Moreover other ways of providing an indication to the golfer a desired shaft-to-forearm angle or wrist radial or ulnar deviation has been achieved are within the spirit and scope of the invention and are commensurate with the present inventor's contribution to the art. Thus the present invention envisions that it may be possible to provide the desired indication using electronics rather than a strictly mechanical training device. To this end, those skilled in the electronics art might be able to devise sensor-based training devices that measure or otherwise detect the shaft-to-forearm angle $\beta$ and provide aural, tactile (e.g. vibration) or other feedback indicating when the $\beta \cong \beta_{opt}$.

It will thus be appreciated that those skilled in the art will be able to devise numerous alternative arrangements that, while not shown or described herein, embody the principles of the invention and thus are in the spirit and scope.

The invention claimed is:

1. A device that provides a particular human-perceptible stimulus to a golfer when the golfer is holding a grip portion of a golf club with both of the golfer's thumbs extending along a shaft of the golf club, the device being configured to provide said particular human-perceptible stimulus only when a shaft-to-forearm angle $\delta$ between a centerline of a forearm of the golfer and a shaft of the golf club is at a predetermined value substantially between 145 degrees and 160 degrees, wherein said device has an interface that can be held in contact with a particular portion of a golf club, wherein said device is configured such that said stimulus is provided at a time when said interface is in contact with said particular portion of the golf club, wherein said particular portion of the golf club is the grip of the golf club, wherein said interface has a curved surface with a varying arc radius, and wherein said device includes an inter-finger element that is attached to said interface and that is so configured that the inter-finger element can extend between adjacent fingers of a hand of the golfer when the golfer is using that hand to hold the curved surface of the interface in contact with the grip of the golf club.

2. The device of claim 1 wherein the device includes a forearm-contacting tip, wherein said particular human-perceptible stimulus is a perceptible amount of pressure exerted on the underside of a forearm of the golfer by the forearm-contacting tip, wherein the device is configured in such a way that the forearm-contacting tip exerts pressure on said underside of the forearm of the golfer only when said shaft-to-forearm angle $\beta$ is at at least said predetermined value, and wherein the device is further configured in such a way that, when said angle $\beta$ is greater than said predetermined value, said tip exerts a higher amount of pressure on said underside of said forearm than said perceptible amount of pressure that said tip exerts on said underside of said forearm of said golfer when said angle β is substantially equal to said predetermined value.

3. The device of claim 1 wherein said curved surface has an arc radius≅0.400 inches.

4. The device claim 1 wherein the length of said arc radius varies along said curved surface between substantially 0.425 inches and 0.395 inches.

5. The device of claim 1 wherein said curved surface is a partial surface of a cylinder or a cone, said partial surface subtending a radial arc angle of less than 180 degrees.

6. The device of claim 5 wherein said partial surface subtends a radial arc angle of between substantially 100 degrees and 120 degrees.

7. The device of claim 1 wherein said interface is configured in such a way that the device will not remain in contact with said particular portion of a golf club unless held there by means external to the device itself.

8. The device of claim 1 wherein said interface includes means for attaching the device to a golf club in such a way that the device will remain attached to the golf club when the golf club is not being held itself.

9. A device that provides a particular human-perceptible stimulus to a golfer when the golfer is holding a grip portion of a golf club with both of the golfer's thumbs extending along a shaft of the golf club, the device being configured to provide said particular human-perceptible stimulus only when a shaft-to-forearm angle β between a centerline of a forearm of the golfer and a shaft of the golf club is at a predetermined value substantially between 145 degrees and 160 degrees, wherein said device has a U-shape comprising first and second arms and a base portion, the first arm comprising an interface and an inter-finger portion, said interface and said inter-finger portion being configured in such a way that the interface can be held in contact with a grip of a golf club by a hand of the golfer with the inter-finger portion extending away from the grip of the golf club between a pair of adjacent fingers of the golfer, the second arm terminating in a tip and the base portion interconnecting the first and second arms, the first and second arms and the base portion being proportioned such that said tip provides a tactile stimulus at the underside of a forearm of the golfer when said shaft-to-forearm angle β is at said predetermined value.

10. The device of claim 9 wherein said interface has a curved surface with a varying arc radius.

11. A golf training device comprising an interface having a curved surface that is a partial surface of a cylinder or a cone, an inter-finger portion connected to said interface having first and second ends, wherein the first end is connected at a convex side of said interface, and wherein a central axis of the inter-finger portion intersects both said interface and the axis of said cylinder or cone, a tactile feedback member having a fixed end and a free end, and a connecting member that connects the second end of the inter-finger portion to the fixed end of the tactile feedback member, the tactile feedback member being such that its free end deflects relative to the training device as a whole in response to a lateral force applied to said free end.

12. The golf training device of claim 11 wherein a distance between a tip of the free end and the connecting member is adjustable.

13. The golf training device of claim 11 wherein the device is configured in such a way that there is an angle α between a first line and a second line, wherein said angle α has a value between substantially 11 degrees and 21 degrees, wherein the first line is a shortest line between a) a point where said arc radius centerline axis intersects with a plane that contains said inter-finger member and b) said tactile feedback member, and wherein the second line is said arc radius centerline axis.

14. The golf training device of claim 11 wherein the device is configured in such a way that there is an angle Ω between a first line and a second line, wherein said angle Ω has a value between substantially 35 degrees and 45 degrees, wherein the first line is a shortest line between a) a point where said arc radius centerline axis intersects with a plane that contains said inter-finger member and b) said tactile feedback member, and wherein the second line is a line extending between said point and a terminating point of said free end.

15. A method performed by a golfer holding a golf club, the method comprising positioning in contact with the golf club a device that provides a particular human-perceptible stimulus to the golfer only when both a) the golfer is holding a grip portion of the golf club with both of the golfer's thumbs extending along a shaft of the golf club, and b) a shaft-to-forearm angle β between a centerline of a forearm of the golfer and a shaft of the golf club is substantially between 145 degrees and 160 degrees, wherein the device includes a forearm-contacting tip, wherein said particular human-perceptible stimulus is a perceptible amount of pressure exerted on a forearm of the golfer by the forearm-contacting tip, wherein the device is configured in such a way that the forearm-contacting tip exerts pressure on a forearm of the golfer only when said shaft-to-forearm angle β is at at least said predetermined value, and wherein the device is further configured in such a way that, when said angle β is greater than said predetermined value, said tip exerts a higher amount of pressure on said underside of said forearm than said perceptible amount of pressure that said tip exerts on said underside of said forearm of said golfer when said angle β is substantially equal to said predetermined value.

16. A device that provides a particular human-perceptible stimulus to a golfer when the golfer is holding a grip portion of a golf club with both of the golfer's thumbs extending along a shaft of the golf club, the device being configured to provide said particular human-perceptible stimulus only when a shaft-to-forearm angle β between a centerline of a forearm of the golfer and a shaft of the golf club is at a predetermined value substantially between 145 degrees and 160 degrees, wherein said device has an interface that can be positioned in contact with a particular portion of a golf club, wherein said device is configured such that said stimulus is provided at a time when said interface is in contact with said particular portion of the golf club, wherein said particular portion of the golf club is the grip of the golf club, and wherein said device includes an inter-finger element that is attached to said interface and that is so configured that the inter-finger element can extend between adjacent fingers of a hand of the golfer when the golfer is using that hand to hold the interface in contact with the grip of the golf club.

* * * * *